United States Patent [19]

Johnson

[11] Patent Number: 4,555,051

[45] Date of Patent: Nov. 26, 1985

[54] SLING FOR SHOULDER WEAPON

[75] Inventor: David A. Johnson, Salem, Oreg.

[73] Assignee: J.F.S., Inc., Salem, Oreg.

[21] Appl. No.: 713,094

[22] Filed: Mar. 18, 1985

Related U.S. Application Data

[63] Continuation of Ser. No. 561,316, Dec. 14, 1983.

[51] Int. Cl.[4] ..... F41C 27/00

[52] U.S. Cl. ..... 224/150; 224/149; 224/913

[58] Field of Search ..... 224/913, 150, 203, 205, 224/257, 910, 258, 264, 255, 149

[56] References Cited

U.S. PATENT DOCUMENTS

| | | | |
|---|---|---|---|
| 2,059,949 | 11/1936 | Imler | 224/150 |
| 2,296,733 | 9/1942 | Paolino | 224/913 X |
| 2,350,484 | 6/1944 | Williams | 224/913 X |
| 2,576,559 | 11/1951 | Bennek | 224/913 X |
| 2,828,058 | 3/1958 | Arpin | 224/149 |
| 2,885,812 | 5/1959 | Arpin . | |
| 2,915,233 | 12/1959 | Moomaw . | |
| 3,211,351 | 10/1965 | Sample . | |
| 3,221,958 | 12/1965 | Straight | 224/149 |
| 3,334,794 | 8/1967 | Saari et al. . | |
| 3,606,109 | 9/1971 | Brokus . | |
| 3,869,074 | 3/1975 | Roach | 224/913 X |
| 4,188,851 | 2/1980 | Wolf | 224/910 X |
| 4,271,999 | 6/1981 | Stravitz | 224/910 X |
| 4,291,822 | 9/1981 | Simonds | 224/257 |

*Primary Examiner*—Stephen Marcus
*Assistant Examiner*—Robert Petrik
*Attorney, Agent, or Firm*—Chernoff, Vilhauer, McClung, Birdwell & Stenzel

[57] ABSTRACT

A sling assembly for carrying shoulder-fired weapons, particularly military rifles, in an upright horizontal ready position. A strap portion of the sling assembly extends rearwardly from a sling swivel on the bottom of the butt stock and then extends upwardly along the butt plate on the rear side of the butt stock, where it is retained detachably by a sleeve slidably disposed on the strap. The sleeve includes a portion of a detachable connector to hold the sleeve and strap against the butt plate, the other mating portion of the fastener being located on the butt end of the stock. The sleeve extends high enough relative to the butt stock so that raising the rifle to the user's shoulder separates the parts of the detachable connector, allowing the sleeve and strap portions of the sling assembly to fall clear of the butt end of the stock while the sling remains connected to the weapon by the sling swivel.

13 Claims, 5 Drawing Figures

14
10
30
34
24
32
16
12
62
46
18
64
20
52
58
38
40
36

34
10
24
28
30
32
26
16
12

24
32
54
30
34
56
50
20
22
58
42
36
40
44
48
46
30

14
60
30
68
50
52
46
48
18
66
20
22
44
58
38
42
40
36

14
10
30
34
32
28
24
26
60
52
18
16
12
48
46

SLING FOR SHOULDER WEAPON

This application is a continuation of application Ser. No. 561,316, filed Dec. 14, 1983.

BACKGROUND OF THE INVENTION

The present invention relates to slings for firearms and the like, and particularly to a sling for carrying a weapon in a generally horizontal position of readiness.

In order to be able to use shoulder weapons such as rifles and the like as quickly as possible, yet have freedom to use their hands, soldiers and hunters would prefer to carry such weapons in a forwardly or laterally directed position with the weapon upright and its barrel or main longitudinal axis approximately horizontal. This position is known as a horizontal ready position.

Rifles, particularly military rifles, have long been equipped with slings permitting them to be carried without encumbering the carrier's hands. Such slings are also useful in bracing such weapons during use, to achieve a better aim. Such slings have conventionally been located on the bottom of a rifle or similar weapon, at least partly because location at the top of the weapon might interfere with using sights mounted low on the top of the weapon. Conventional slings, however, do not permit a weapon to be carried suspended by the sling in the preferred horizontal ready position, and moving the point of attachment of a sling to the top of a weapon so that it might be carried in a horizontal ready position has previously resulted in the sling interfering with the ability to quickly raise the weapon to the proper position against the user's shoulder. For example, when a sling is attached at the top of the rear end of the butt stock, raising the weapon to a horizontal position with the butt end against the shoulder of the user might result in the sling being caught between the butt end and the user's shoulder, or lying across the top of the cheek rest area of the stock, where it would adversely affect the ability to aim the weapon quickly and accurately. Since the ability to carry a weapon in the so-called "horizontal ready" position can provide a definite advantage in quickness of use either in hunting or in infantry warfare, it is desirable to provide a sling which has this capability, in conjunction with the ability to be used in the conventional manner.

Brokus U.S. Pat. No. 3,606,109 discloses a gun sling including a socket loosely fitted to the underside of the rear of the stock, to facilitate carrying a gun in a horizontal ready position. The socket taught by Brokus, however, is undesirably bulky and apparently does not positively remain in place unless tension is maintained in the sling.

Moomaw U.S. Pat. No. 2,915,233 teaches a gun sling including a stock-supporting loop or socket which enables a gun to be carried in a horizontal ready position. Raising the gun from a horizontal ready position to a normal firing position with its stock against the user's shoulder, however, completely disconnects the rear end of the sling from the stock, requiring it to be replaced on the stock before the sling can be used subsequently to carry the gun in any position whatever.

Sample U.S. Pat. No. 3,211,351 and Saari et al. U.S. Pat. No. 3,334,794 disclose gun slings which are fastened to a forward portion of a gun and also around the stock of the gun at a position adjacent a pistol grip substantially forward of the rear end of the stock. This position of attachment adjacent the pistol grip portion of a stock permits the weapon to be carried conveniently. However, it creates an undesirable potential for interference with use of the weapon, as the sling would pass under the user's arm when the weapon is raised to the user's shoulder from a horizontal ready position.

Arpin U.S. Pat. No. 2,885,812 provides a detachable swivel connection to attach an end of a gun sling to a side of the butt end of a gun stock. While such a sling can be used to carry a rifle or the like in position approximating the horizontal ready position which is most desirable, the connection of the sling to the side of the stock would tend to interfere with use of the sling in the conventional manner to carry the rifle.

What is needed, therefore, is a sling assembly which can be used in the same manner as a conventional rifle sling, yet can also be used to carry a weapon in a position of readiness in which the weapon is upright with its longitudinal main axis directed generally horizontally, and which does not interfere with the ability to raise the weapon rapidly and bring the butt end of its stock to the user's shoulder in a proper position for use of the weapon.

SUMMARY OF THE INVENTION

The present invention overcomes the shortcomings of the previously known slings for rifles and the like and provides a sling assembly which can be used to carry a military rifle or similar weapon in a conventional position slung across the carrier's back, which can be used to brace the weapon during shooting, and which also permits a weapon to be carried with the sling supporting the weapon in a substantially upright and horizontally extending position leaving the carrier's hands free for other tasks.

According to the present invention a rifle sling is fastened to a point of attachment at the front or muzzle end of a rifle or the like, and an opposite, or rear, end portion of the sling is attached at the conventional location at the bottom of the stock of the weapon, near the butt end. A detachable connector such as a snap fastener is located on a sleeve slidably disposed on the sling and holds a portion of the tension-transmitting strap portion of the sling closely adjacent the butt plate of the stock of the rifle. The sleeve extends upwardly far enough, relatively to the butt end of the stock, to cause the rifle to hang in an upright position when suspended from the sling with its barrel generally horizontal. That is, with the detachable connector fastened, holding the sleeve and the portion of the strap adjacent the butt end of the stock, the center of gravity of the weapon is below a line interconnecting the front point of attachment of the sling with the upper end of the sleeve.

Preferably, the sleeve on which a portion of the detachable connector is located extends upwardly above the top of the rear end of the stock of the weapon when the detachable connector is fastened, so that the detachable connector may be disconnected by rearward pressure against the front of the sleeve exerted by the user's arm as the weapon is raised and brought ahead to its normal shooting position with the stock against the front of the user's shoulder.

It is therefore a principal objective of the present invention to provide an improved sling assembly for weapons such as military rifles for holding such weapons in an upright horizontal ready position, while keeping the user's hands free for other purposes.

It is another important objective of the present invention to provide a sling assembly for a military rifle which is usable to carry such a weapon in a conventional manner, which permits the sling to be used to aid in aiming the weapon, and which also is usable to carry the weapon in a horizontal ready position.

It is an important feature of the present invention that it provides a conveniently detachable connector for attaching a sling to the butt end of a stock of a rifle or similar weapon while the sling remains attached to the conventional position at the lower side of the stock of such a weapon.

It is another feature of the present invention that it includes a detachable connector for connecting a part of the sling to the butt plate, one part of the connector being countersunk within the butt plate of the stock of a weapon so that it does not interfere with normal use of the weapon when the sling is disconnected from the butt plate.

It is yet a further feature of the present invention that a portion of the detachable connector used to hold a portion of the sling adjacent the butt plate of the weapon's stock is carried on a sleeve which is movable along the strap portion of the sling, so that the sling may be adjusted as desired.

It is an important advantage of the sling provided by the present invention that it is lighter and less cumbersome than previously known devices intended to facilitate carrying a weapon in a horizontal ready position.

It is another important advantage of the sling provided by the present invention that it is easier to reconnect it to the butt end of a rifle stock to carry a rifle in a horizontal ready position than previously known devices for the same purpose.

The foregoing and other objectives, features and advantages of the present invention will be more readily understood upon consideration of the following detailed description of the invention taken in conjunction with the accompanying drawings.

DETAILED DESCRIPTION OF THE PREFERRED EMBODIMENT

Figure 1:
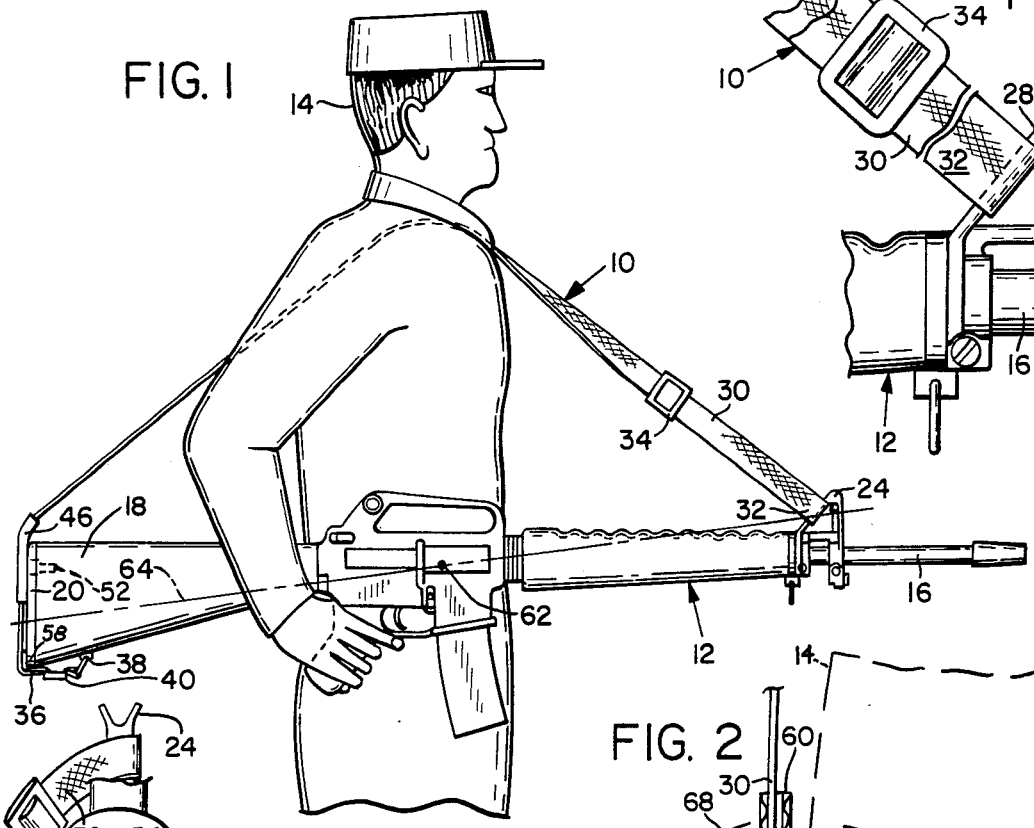
FIG. 1 is a view of a soldier carrying a rifle equipped with a sling assembly embodying the present invention, with the rifle suspended in a horizontal ready position.

Referring now to the drawings, a sling assembly 10 which is a preferred embodiment of the present invention is shown in conjunction with a military rifle 12 which is similar to the M-16 automatic rifle used by the armed forces of the United States and some other countries. As shown in FIG. 1, the rifle 12 is carried by a soldier 14, with the rifle 12 suspended by means of the sling assembly 10 in a "horizontal ready" position. In the horizontal ready position, the rifle 12 is substantially upright, with its barrel 16 extending generally horizontally. References herein to the top, bottom, lower, and front or rear portions of the rifle 12 will be based upon this orientation of the rifle 12.

Figure 3:
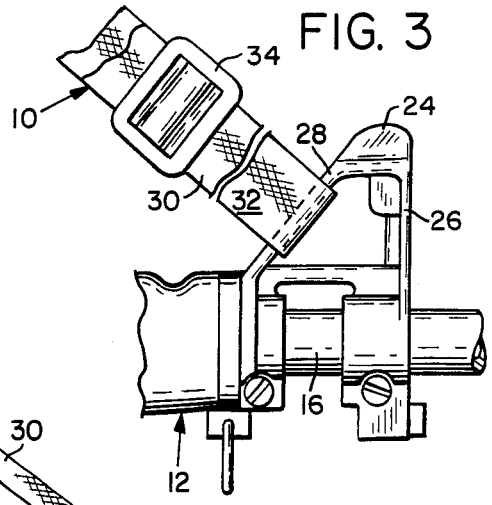
FIG. 3 is a side elevational view, at an enlarged scale, of front portions of the rifle and the sling assembly shown in FIG. 1.
Figure 2:
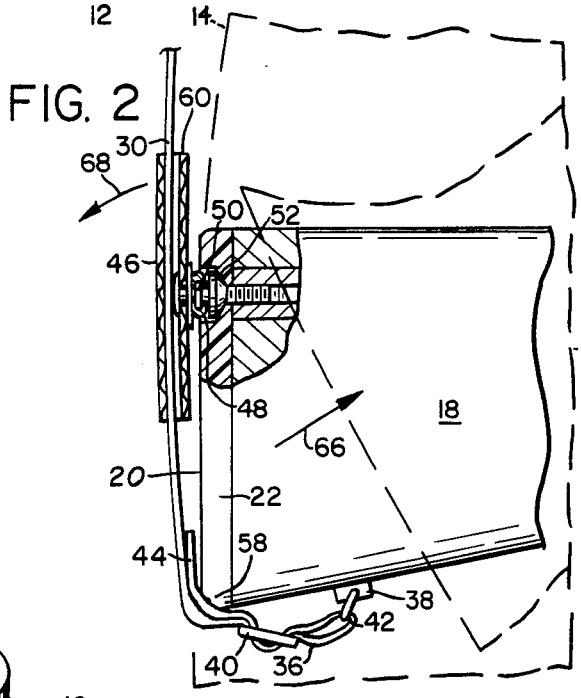
FIG. 2 is a partially cut-away side elevational view, at an enlarged scale, of a portion of the butt stock of the rifle and a portion of the sling assembly shown in FIG. 1.

The rifle 12 includes a butt stock 18 having a butt end 20, including a butt plate 22, shown in FIG. 2. The butt plate 22 is normally held against the front of the shoulder of a person firing the rifle 12 in order to transfer the rearward forces generated during firing to the user's shoulder. The rifle 12 has a front sight 24, shown in greater detail in FIG. 3, which extends upwardly above the barrel 16 and includes a vertical portion 26 and a sloping portion 28.

The sling assembly 10 includes a tension-transmitting strap 30, which is preferably of strong woven synthetic fiber fabric construction, although it may also be made of leather or other material capable of carrying the weight of the rifle 12. A first or front end portion 32 of the strap 30 is attached to the rifle's front or muzzle end by being looped around the sloping portion 28 of the front sight 24, and is held in place by a buckle 34. The buckle 34 is preferably a simple one-piece slidable buckle having a pair of ends and a parallel central bar, all extending laterally across the width of the strap 30, to hold the strap frictionally in a well-known manner to prevent it from slipping, yet permit adjustment to the desired length.

Figure 4:
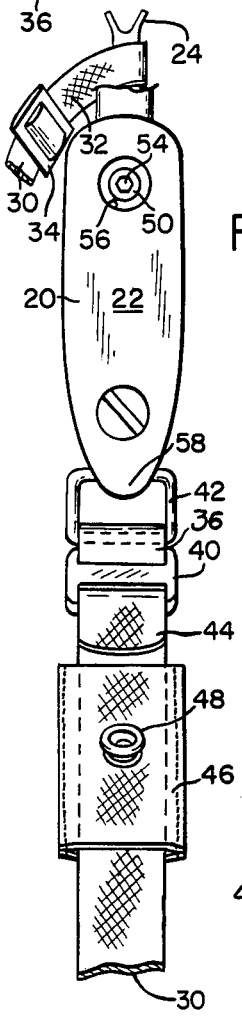
FIG. 4 is a rear end elevational view, at an enlarged scale, of the rifle and sling assembly shown in FIG. 1, showing the sling assembly in a configuration permitting the rifle to be fired normally.

A second or rear end portion 36 of the sling strap 30 is connected to a sling swivel 38 by means of a buckle 40, shown also in FIG. 4, which may be of the same construction as the buckle 34. The sling swivel 38 is located in the conventional position on the bottom of the butt stock 18, a short distance ahead of the butt end 20. If the sling swivel is of a type in which the link portion 42 is limited in its ability to swing, it may be desirable to reverse the position of the sling swivel 38 so that its link 42 can swing rearwardly to lie close to the bottom surface of the butt 18, extending toward the butt plate 22.

The tri-bar slide buckle 40 should be located snugly against the sling swivel 38. This will provide support for the rear or second end portion 36 of the strap 30 in a position close enough to the lower rear corner 58 of the butt stock 18 so that the strap 30 will mold itself around the lower rear corner 58 of the butt stock 18, as shown in FIG. 2, and will not readily slip off it to either side, when the strap 30 is held against the butt end 20 as will be explained subsequently. Preferably, the tip 44 of the strap 30 extends only a very short distance beyond the buckle 40 and lies between the strap 30 and the lower rear corner of the butt end 20, when the strap 30 extends rearwardly from the sling swivel 38 and upwardly along the surface of the butt plate 22.

A sleeve 46, shown partially cut away in FIG. 2, is slidably disposed upon the strap 30 between the front end portion 32 and the rear end portion 36. The sleeve 46 may be made of strong material similar to that of the strap 30, but of slightly greater width, permitting the sleeve 46 to be made of two layers of the material, joined by seams parallel to the edges and separated far enough to receive the strap 30. The sleeve 46 may also be of leather or other material of sufficient strength to accept and securely hold a portion of a detachable fastener such as a snap gripper having a female portion 48 riveted or otherwise permanently fastened to one flat side of the sleeve 46. Preferably, the sleeve 46 fits snugly about the strap 30, so that the sleeve 46 will not slide along the strap 30 merely of its own weight, yet may be slid along the strap 30 in response to application of a moderate amount of force. Because the sleeve 46 slides along the strap 30, the weight of the rifle 12 is carried by the rear end portion 36 and the sling swivel 38, rather than being concentrated at a single point where a part of a snap gripper might be attached to the strap 30, and the buckle 40 may be adjusted as desired.

A male portion 50 of the strap gripper is incorporated in the shape of a fastener such as a special screw 52 which replaces the screw ordinarily located near the top of the butt plate 22 to attach the butt plate 22 to the butt end 20 of the stock 18. The screw 52 is perferably of hard chrome steel to ensure sufficient strength and avoid corrosion. In particular, for use with an M-16 rifle, the screw 52 includes a tapered, countersunk portion which is of larger diameter than the male portion 50, and a hexagonal cavity 54 is located in the center of the male portion 50 as a drive socket for turning the screw 52 with the use of an Allen wrench. Because the countersunk portion of the head of the screw 52 is of larger diameter than the male portion 50 of the snap gripper, an annular cavity 56 is defined around the male portion 50 when the screw 52 is fastened into the butt stock 18 at a depth at which the male portion 50 is sunk flush with the surface of the butt plate 22. The annular cavity 56 provides enough room for the female portion 48 of the snap gripper to matingly fit around the male portion 50 and thus attach the sleeve 46 to the butt end 20 of the butt stock 18 without the male portion 50 protruding from the butt plate 22.

With the sleeve 46 fastened to the butt stock 18 by mating connection of the female portion 48 with the male portion 50, a portion a the strap 30 is held adjacent the butt plate 22. The sleeve 46 preferably extends upwardly above the top of the butt stock 18 when the female portion 48 and male portion 50 are matingly connected together. With the sleeve 46 located on the strap 30 so that the strap 30 is snugly wrapped around the lower rear corner 58 of the butt stock 18, the sleeve 46 prevents any substantial lateral movement of the strap 30, with respect to the butt stock 18, except above the upper end 60 of the sleeve 46. Thus the center of gravity 62 of the rifle 12 is below an imaginary line 64 interconnecting the point of attachment of the front portion 32 of the strap 30 to the sloping portion 28 of the front sight 24 with the upper end 60 of the sleeve 46. To state this another way, an extended imaginary line 64 extending through the sloping portion 28 and the center of gravity 62 passes beneath the upper end 60 of the sleeve 46. Thus when the female portion 48 and male portion 50 of the snap gripper are matingly connected with one another the rifle 12 will hang in an upright orientation, tilted neither left nor right, as shown in FIG. 4. By placing the strap 30 behind the right shoulder and around the left side of the neck of the soldier 14, the rifle 12 may be placed in the desired horizontal ready position, leaving the soldier's hands free to carry other objects, move objects out of his path, or perform other tasks while the rifle 12 remains in the horizontal ready position.

Figure 5:
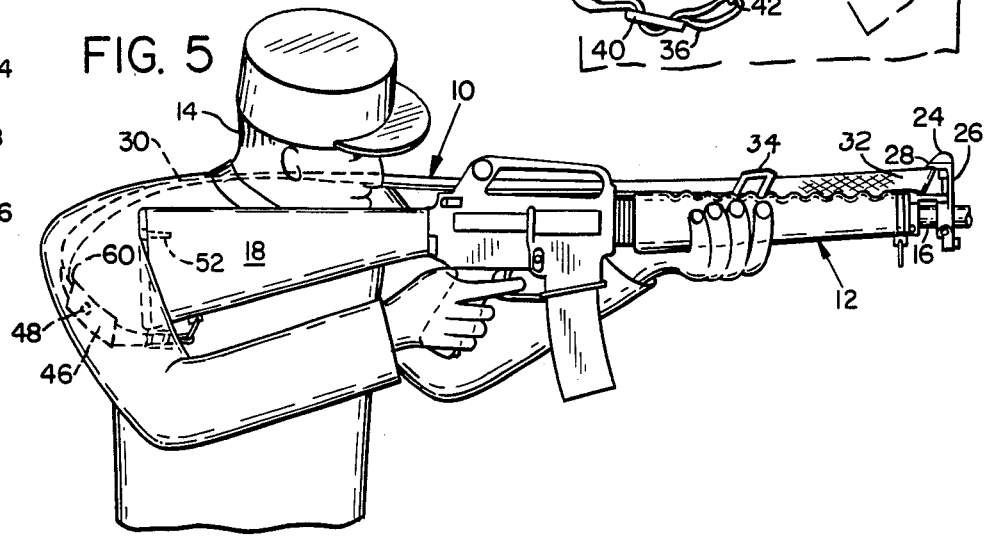
FIG. 5 is a view of the rifle and sling assembly shown in FIG. 1, showing the configuration of the sling assembly during shooting of the rifle.

Referring again to FIG. 2 and now also to FIG. 5, it may be seen that as the rifle 12 is lifted by the soldier 14, from the horizontal ready position shown in FIG. 1 to the shooting position shown in FIG. 5, the upper end 60 of the sleeve will encounter the rear or lower part of the soldier's arm or shoulder. This contact, during forward and upward movement of the butt stock 18, as indicated by the arrow 66, pulls the male portion 50 of the snap gripper away from the female portion 48, leaving the sleeve 46 and strap 30 free to fall rearwardly and downwardly away from the butt plate 22, as indicated by the arrow 68. The rifle 12 may thus be raised to the usual shooting position, in which the butt plate 22 is snugly held against the front of the shoulder of the soldier 14. The strap 30 is then left hanging suspended from the rear sling swivel 38 in the conventional manner as shown in FIG. 5 and in broken line in FIG. 2, and thus is not in a position to obstruct use of the rifle 12.

Since the sleeve 46 does not slide freely along the strap 30 without intentional application of force by the user, the sleeve 46 may easily be reattached to the butt end 20 of the stock 18 merely by refastening the female portion 48 to the male portion 50 of the snap gripper, making the sling assembly 10 again ready for carrying the rifle 12 in the horizontal ready position.

It will be readily apparent that the sling assembly 10 will not be limited to use in conjunction with military rifles, but that it will also be useful for carrying other military weapons such as grenade launchers, automatic rifles, and submachine guns, among others. It will also be apparent that the sling assembly 20 will be of value with hunting rifles and shotguns.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sling assembly for carrying a weapon of the type having a front portion and a butt stock located rearwardly from said front portion and including a butt end and a bottom portion, the sling assembly comprising:

(a) a flexible sling strap member having a pair of opposite end portions and an intermediate portion;

(b) sling swivel means attached to a first one of said pair of opposite end portions for connecting said first one of said pair of opposite end portions to said butt stock;

(c) attachment means for fastening the other one of said pair of opposite end portions to said front portion of said weapon;

(d) detachable mechanical fastener means, including a pair of cooperatively mating portions; and (e) a sleeve surrounding a portion of said sling strap member intermediate said opposite end portions thereof, a first one of said cooperatively mating portions being mounted on said sleeve and said sleeve being movable along said sling strap member intermediate said opposite end portions thereof and a second one of said cooperatively mating portions being fixedly located on said butt end of said butt stock, for selectively detachably holding said intermediate portion of said sling strap member in a position rearwardly adjacent said butt end of said butt stock and extending upwardly therealong while said opposite end portions are fastened to said butt stock and said front portion by said sling swivel means and said attachment means.

2. The sling assembly of claim 1 wherein said detachable mechanical fastener means is a snap gripper of the type in which said cooperatively mating portions comprise a male portion and a resiliently gripping female portion, one of said male and female portions having means associated therewith for fixedly attaching said one of said male and female portions to said butt end of said butt stock.

3. The sling assembly of claim 2, said means for fixedly attaching including screw means fixedly connected with said male portion and adapted for extending into said butt end of said butt stock in place of a butt plate attachment screw.

4. In combination with a rifle having a front portion and a rearwardly located butt stock including a top, a bottom, and a butt end, a sling assembly comprising:

(a) an elongate flexible sling strap having a front end portion connected to said rifle at a first point of attachment located on said front portion thereof and a rear end portion connected to said bottom of said butt stock adjacent said butt end;

(b) a sleeve slidably disposed on said sling strap and surrounding a portion thereof intermediate said front and rear end portions thereof; and (c) a selectively detachable mechanical fastener having a first part thereof fixedly attached to said sleeve and a matingly connectable second part thereof fixedly located in such a location on said butt end of said butt stock, that when said first and second parts of said mechanical fastener are matingly connected with one another said sleeve holds a portion of said sling strap intermediate said front and rear end portions adjacent said butt end of said butt stock, extending upwardly therealong, and said sleeve extends above the top of said butt stock.

5. The sling assembly of claim 4 wherein said rifle includes a sling swivel located on said bottom of said butt stock and said rear end portion is attached to said sling swivel.

6. The sling assembly of claim 4 wherein said sleeve fits snugly on said strap, requiring more force than the weight of said sleeve to move said sleeve along said strap.

7. In combination with a shoulder weapon of the type having a front portion and a rearwardly located butt stock including a butt end having a lower rear corner, a sling assembly comprising:

(a) a flexible sling strap member having a pair of opposite end portions and an intermediate portion;

(b) sling swivel means attached to said butt stock adjacent said lower rear corner of said butt stock for attaching a first one of said opposite end portions of said sling strap to said butt stock adjacent said lower rear corner thereof;

(c) attachment means for fastening the other one of said pair of opposite end portions to a front portion of said weapon at a front point of attachment; and (d) detachable mechanical fastener means, including a pair of cooperatively mating portions, a first one of said cooperatively mating portions being attached to and moveable along said sling strap member intermediate said opposite end portions thereof and a second one of said cooperatively mating portions thereof being fixedly located on said butt end of said butt stock, for selectively detachably holding said intermediate portion of said sling strap member in a position rearwardly adjacent said butt end of said butt stock and extending upwardly therealong while said opposite end portions are fastened to said butt stock and said front portion, respectively.

8. The sling assembly of claim 7, wherein said first one of said cooperatively mating portions is matable with said second one of said cooperatively mating portions by urging said first one of said cooperatively mating portions toward said butt end when said first and second cooperatively mating portions are aligned with one another, and wherein said first one of said cooperatively mating portions is detachable from said second one of said cooperatively mating portions by movement of said first one of said detachable portions directly away from said butt end.

9. The sling assembly of claim 7 wherein said detachable mechanical fastener means, when connected, holds said intermediate portion of said sling strap member adjacent said butt end of said butt stock in a position at least as high as an imaginary line connecting said front point of attachment with the center of gravity of said weapon.

10. The sling assembly of claim 7 wherein said detachable mechanical fastener means is attached to said sling strap by a sleeve surrounding and slidably disposed on said intermediate portion of said sling strap member, said sleeve extending along said sling strap member to a position at least high enough with respect to said butt end to substantially prevent lateral movement of said sling strap member with respect to said butt stock at a position at least as high as a line extending through said front point of attachment and the center of gravity of said weapon when said weapon is in an upright horizontal attitude.

11. The sling assembly of claim 7, wherein said first cooperatively mating portion of said detachable mechanical fastener means is mounted on a sleeve surrounding and slidably disposed upon said sling strap member, said second cooperatively mating portion of said detachable mechanical fastener means being located on said butt end, and said sleeve extending above the tope of said butt end of said butt stock when said detachable mechanical fastener means is connected.

12. The sling assembly of claim 7 wherein said detachable mechanical fastener is a snap gripper of the type having a male portion and a female portion which resiliently fits around and grips the male portion, wherein the male portion is part of the head of the screw, the screw being located in said butt end of said butt stock and being countersunk therein, said butt end defining a cavity surrounding said male portion and providing clearance for receiving said female portion therein in matingly gripping interconnection with said male portion.

13. The sling assembly of claim 7, said detachable mechanical fastener means including a snap gripper including said pair of cooperatively mating portions, and a fastener extending into said butt end, one of said cooperatively mating portions being fixedly attached to said fastener, and said butt end defining a cavity surrounding said one of said cooperatively mating portions, the other of said cooperatively mating portions of said detachable mechanical fastener means being attached to said intermediate portion of said sling strap member.

* * * * *

UNITED STATES PATENT AND TRADEMARK OFFICE

CERTIFICATE OF CORRECTION

PATENT NO. : 4,555,051

DATED : November 26, 1985

INVENTOR(S) : David A. Johnson

It is certified that error appears in the above-identified patent and that said Letters Patent is hereby corrected as shown below:

| | | |
|---|---|---|
| Col. 2, | Line 45 | Change "relatively" to --relative--. |
| Col. 5, | Line 8 | Change "strap" to --snap--; |
| Col. 7, | Line 44 | After "portion" insert --located between said opposite portions;--; |
| | Line 45 | Delete "sling swivel" and after "attached" insert --fixedly--; |
| | Line 46 | After "corner" delete --of said butt stock-- and insert --thereof--; |
| | Line 56 | After "said" insert --intermediate portion of said-- and after "member" insert a comma; |
| | Line 57 | Delete "intermediate said opposite end portions thereof". |
| Col. 8, | Line 15 | Delete the comma following "means" and insert --is located so that,-- and after "connected," insert --said detachable mechanical fastener means--; |
| | Lines 37, 38, 39 | Delete "said second cooperatively mating portion of said detachable mechanical fastener means being located on said butt end, and"; |
| | Line 40 | Change "tope" to --top--; |

UNITED STATES PATENT AND TRADEMARK OFFICE

CERTIFICATE OF CORRECTION

PATENT NO. : 4,555,051

DATED : November 26, 1985

INVENTOR(S) : David A. Johnson

It is certified that error appears in the above-identified patent and that said Letters Patent is hereby corrected as shown below:

| | | |
|---|---|---|
| Col. 8, | Line 41 | After "said" delete "detachable mechanical fastener means is connected" and insert --cooperatively mating portions are mated--; |
| | Line 46 | Change "the" to --a--; |
| | Line 47 | After "located" insert --and countersunk--; |
| | Line 48 | After "stock" insert a comman and delete "and being countersunk therein,"; |
| | Line 56 | After "end," insert --said second--; |
| | Line 59 | After "surrounding said" insert --second--; |
| | Lines 60, 63 | Delete ", the other of said cooperatively mating portions of said detachable mechanical fastener means being attached to said intermediate portion of said sling strap member--. |

Signed and Sealed this

Fourth Day of November, 1986

[SEAL]

*Attest:*

DONALD J. QUIGG

*Attesting Officer*

*Commissioner of Patents and Trademarks*